United States Patent [19]

Kindt

[11] 4,436,405

[45] Mar. 13, 1984

[54] APPARATUS AND METHOD FOR REGISTERING RELATED TRANSFERABLE IMAGES IN ACCURATE SUPERPOSITION ON A RECEIVER MEMBER

[75] Inventor: Robert J. Kindt, Rochester, N.Y.

[73] Assignee: Eastman Kodak Company, Rochester, N.Y.

[21] Appl. No.: 427,238

[22] Filed: Sep. 29, 1982

[51] Int. Cl.[3] ..... G03G 15/01

[52] U.S. Cl. ..... 355/3 TR; 355/4; 355/14 TR; 355/14 SH; 355/3 SH; 118/645; 101/177; 430/357

[58] Field of Search ..... 355/3 TR, 14 TR, 4, 355/3 SH, 14 SH, 14 D; 118/645, 621; 96/1.2; 101/177, 246, 186; 271/243, 246; 430/357, 394

[56] References Cited

U.S. PATENT DOCUMENTS

| | | | |
|---|---|---|---|
| 2,986,466 | 5/1961 | Kaprelian | 355/4 X |
| 3,519,343 | 7/1970 | McNair et al. | 355/4 |
| 3,520,603 | 7/1970 | Gnage | 355/4 |
| 3,531,195 | 9/1970 | Tanaka et al. | 355/4 |
| 3,532,422 | 10/1970 | McFarlane | 355/4 |
| 3,551,046 | 12/1970 | Gnage | 355/4 |
| 3,559,571 | 2/1971 | Scherer et al. | 101/186 |
| 3,612,677 | 6/1969 | Langdon et al. | 355/4 |
| 3,633,543 | 1/1972 | Pitasi et al. | 118/621 |
| 3,705,767 | 12/1972 | Tamai et al. | 355/4 |
| 3,724,943 | 4/1973 | Draugelis et al. | 355/4 |
| 3,734,607 | 5/1973 | Davis et al. | 355/4 |
| 3,841,751 | 10/1974 | Draugelis et al. | 355/4 |
| 3,845,951 | 6/1973 | Hamaker | 271/243 |
| 3,947,114 | 3/1976 | Washio et al. | 355/4 |
| 3,957,367 | 5/1976 | Goel et al. | 355/4 |
| 3,958,876 | 5/1976 | Terashima | 355/4 |
| 4,014,608 | 3/1977 | Terashima | 355/4 |
| 4,082,443 | 4/1978 | Draugelis et al. | 355/4 |
| 4,120,577 | 10/1978 | Watanabe et al. | 355/4 |
| 4,135,927 | 1/1979 | Draugelis et al. | 96/1.2 |

*Primary Examiner*—A. C. Prescott

*Attorney, Agent, or Firm*—Lawrence P. Kessler

[57] ABSTRACT

In an electrographic copier forming related transferable images at spaced locations on an image-carrier and transferring such images seriatim to a receiver member by actuation of a movable transfer mechanism, an improvement for registering such related images in accurate superposition on such member. The image-carrier, moving along a path, is stopped in such path to position one transferable image at a predetermined location. The receiver member is clamped to the means for stopping the image-carrier. During movement of the transfer mechanism, the clamped receiver member is positioned in transfer relation with the transferable image on the stopped image-carrier, and the mechanism is actuated to transfer such image to the member. Following transfer, the receiver member is removed from such transfer relation while keeping such member clamped to the stopping means so that the image carrier can be stopped to position another related transferable image at such predetermined location. The receiver member thus has the same position relative to such other transferable image as it had to the one transferable image, whereby such related images, when transferred, are in accurate superposed register on such member.

12 Claims, 11 Drawing Figures

APPARATUS AND METHOD FOR REGISTERING RELATED TRANSFERABLE IMAGES IN ACCURATE SUPERPOSITION ON A RECEIVER MEMBER

BACKGROUND OF THE INVENTION

This invention relates generally to electrographic copier transfer apparatus, and more particularly to apparatus for electrostatically transferring related transferable images from an image carrier in accurate superposed register on a receiver member.

Recent developments in electrographic copiers have enabled multicolor reproductions (copies) to be produced from multicolor input information. In making such multicolor copies, electrostatic charge patterns respectively corresponding to color separation images of information to be reproduced, are formed on an insulating member (image-carrier). The image-carrier is suitably a continuous web (see U.S. Pat. No. 3,612,677 issued Oct. 12, 1971 in the name of Langdon et al), or a plurality of chips (see U.S. Pat. No. 3,583,807 issued June 8, 1971 in the name of Pollock). The charge patterns are developed with appropriately colored electroscopic marking particles (toner) to form related transferable toner images. Such images are transferred from the image-carrier seriatim to a receiver member in superposed register to form the multicolor reproduction.

The apparatus of the '807 patent has distinct advantages in making multicolor reproductions. For example, in the electrophotoconductive process, the exposure times for forming the respective charge patterns are individually tailored to account for the different spectral characteristics of the image-carrier. Moreover, development of the respective charge patterns can take place simultaneously to improve productivity of the apparatus when compared to apparatus where development of the charge patterns occurs sequentially. However, as is the case with all multicolor reproduction apparatus, registering the receiver member in alignment with the related transferable toner images on the image-carrier for accurate superposed register of the transferred images to such receiver member has proven difficult. Such accurate superposed register is important in that the transferred images must be in accurate register for the colors of the multicolor reproduction to be faithfully reproduced.

SUMMARY OF THE INVENTION

This invention relates to an improvement for registering related transferrable images in accurate superposed register onto a receiver member in an electrographic copier forming such related transferable images at spaced locations on an image-carrier and transferring such images seriatim to a receiver member by actuation of a movable transfer mechanism. The image-carrier, moving along a path, is stopped in such path to position one transferable image at a predetermined location. The receiver member is clamped to the means for stopping the image-carrier. During movement of the transfer mechanism, the clamped receiver member is positioned in transfer relation with the transferable image on the stopped image-carrier, and the mechanism is actuated to transfer such image to the member. Following transfer, the receiver member is removed from such transfer relation while keeping such member clamped to the stopping means so that the image carrier can be stopped to position another related transferable image at such predetermined location. The receiver member thus has the same position relative to such other transferable image as it had to the one transferable image, whereby such related images, when transferred, are in accurate superposed register on such member.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings in which.

DESCRIPTION OF THE PREFERRED EMBODIMENT

Figure 1:
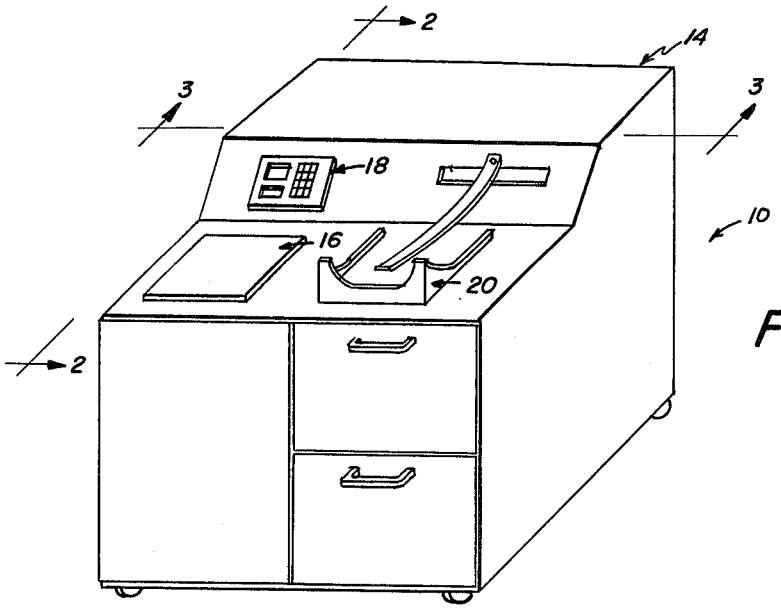
FIG. 1 is a view in perspective of an electrophotographic copier incorporating the registering apparatus according to this invention.

Referring now to the accompanying drawings, FIGS. 1-4 show an electrophotographic copier 10 utilizing an image-carrier transported about a path into operative relation with electrophotographic process stations. The copier 10 includes a housing 14 supporting a transparent platen 16, an operator control and display panel 18, and a copy output hopper 20. The panel 18 is operatively coupled to a logic and control unit 22 (see FIG. 2). The unit 22, which includes a microprocessor, receives operator input signals from the panel 18 and timing signals, for example from sensors 23 detecting transport of the image-carrier about its travel path. Based on such signals and a program for the microprocessor, the unit 22 produces signals to control the timing of operation of the various electrophotographic process stations for carrying out the reproduction process. The production of a program for a number of commercially available microprocessors such as INTEL model 8080 or model 8085 microprocessor (which along with others are suitable for use with the invention), is a conventional skill well understood in the art. The following disclosure is written to enable a programmer having ordinary skill in the art to produce an appropriate control program for the microprocessor. The particular details of any such program would, of course, depend on the architecture of the designated microprocessor.

Figure 2:
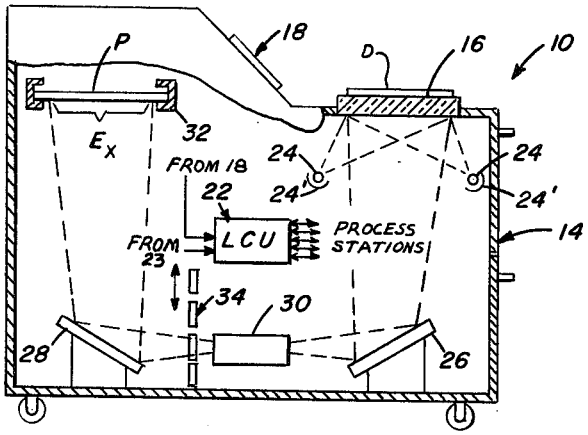
FIG. 2 is a schematic side elevational view, in cross-section, of the structure of FIG. 1, taken along the lines 2—2 of FIG. 1, with portions removed to facilitate viewing.
Figure 11:
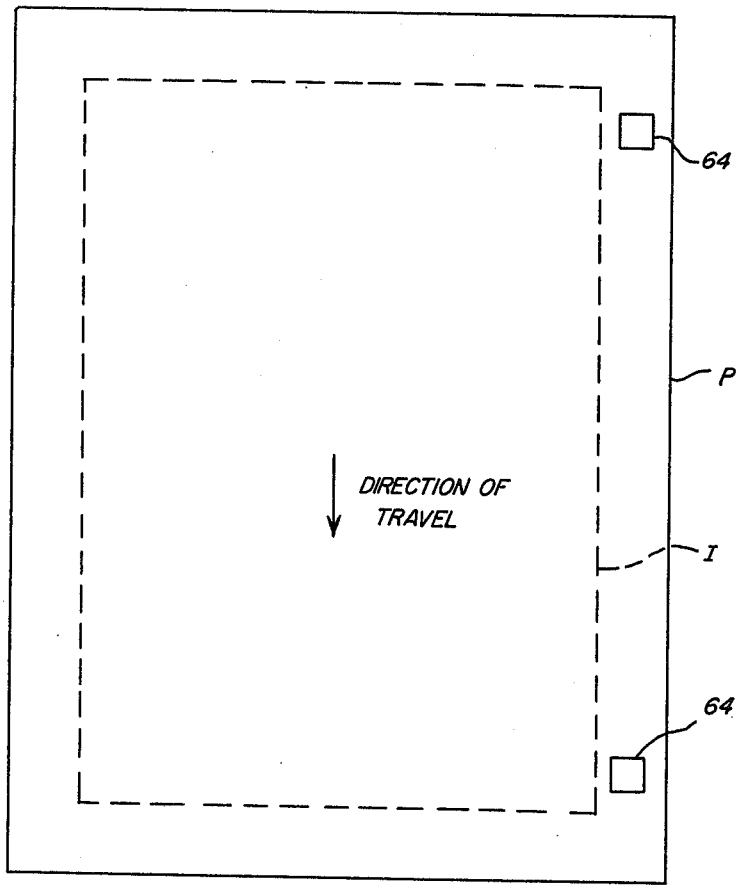
FIG. 11 is a plan view of an exemplary image-carrier sheet.

Lamps 24, and associated reflectors 24', are located within the housing 14 adjacent to the transparent platen 16 (see FIG. 2). The information-bearing surface of a document D to be reproduced is placed on the platen. Light from the lamps is reflected from the information-bearing surface and directed along an optical path by mirrors 26, 28 and lens 30 to zone $E_x$. At the zone $E_x$, the reflected light exposes an image-carrier in an image-wise configuration corresponding to the information on such surface. The image-carrier is, for example, insulative polyester film bearing a layer of photoconductive material and a grounded layer of conductive material, such as the photoconductive film described in U.S. Pat. No. 3,615,414, issued Oct. 26, 1971, in the name of Light. The image-carrier is in the form of cut individual film sheets or a continuous web. When the image carrier is individual film sheets P, each sheet has perforations 64 which are engaged by a registration apparatus (not shown) for stopping such sheet at a registration location in the zone $E_x$. This establishes an image receiving area I on such sheet (see FIG. 11). Of course, in place of perforations, notches along a marginal edge of a sheet are suitable for use with this invention. If the image-carrier is in the form of a continuous web, multicolor document with the subtraction color y be printing process, the document is illuminated a n the web as disclosed in U.S. Pat. No. 3,914,047 in the name of Hunt et al issued Oct. 21, 1975.

In making a multicolor reproduction of a multicolor document with the subtraction color printing process, the document is illuminated a plurality of times at sequentially timed intervals. The reflected light is passed respectively through red, green and blue filters 34 forming related color separation images of the document. With certain documents, the reproduction is also to include a portion of the information reproduced in black, such as line copy for example. In making such reproductions, all information but that to be reproduced in black is masked and the document is then illuminated a fourth time through a neutral density filter to form an image of such black portion. Energizing of the lamps 24 and positioning of the filters 34 in the optical path between the platen 16 and exposure zone $E_x$ are controlled by signals produced by the unit 22. Such images are directed to zone $E_x$ where they expose the image receiving areas of uniformly electrostatically charged image-carrier sheets P respectively.

Figure 3:
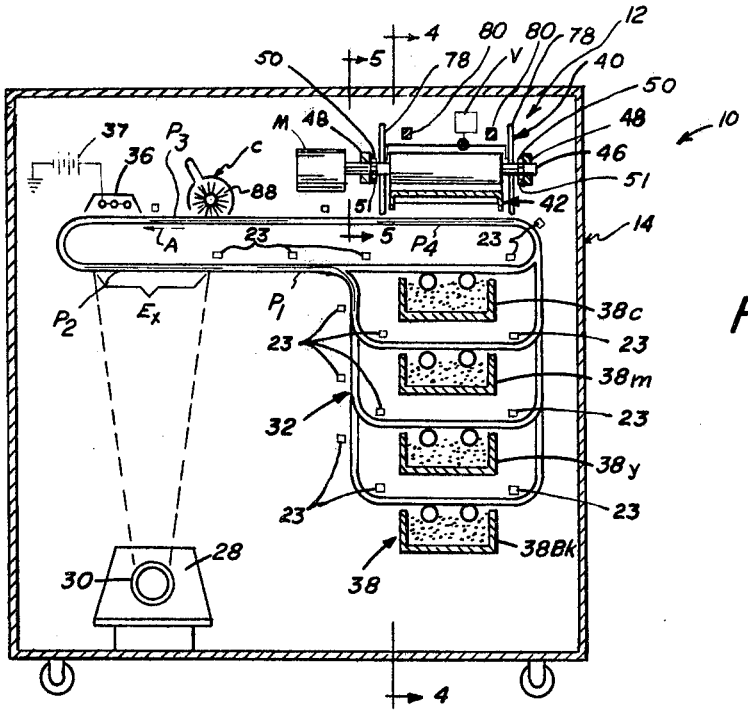
FIG. 3 is a schematic front elevational view, in cross-section, on an enlarged scale, of the structure of FIG. 1, taken along the lines 3—3 of FIG. 1, with portions removed to facilitate viewing.
Figure 4:
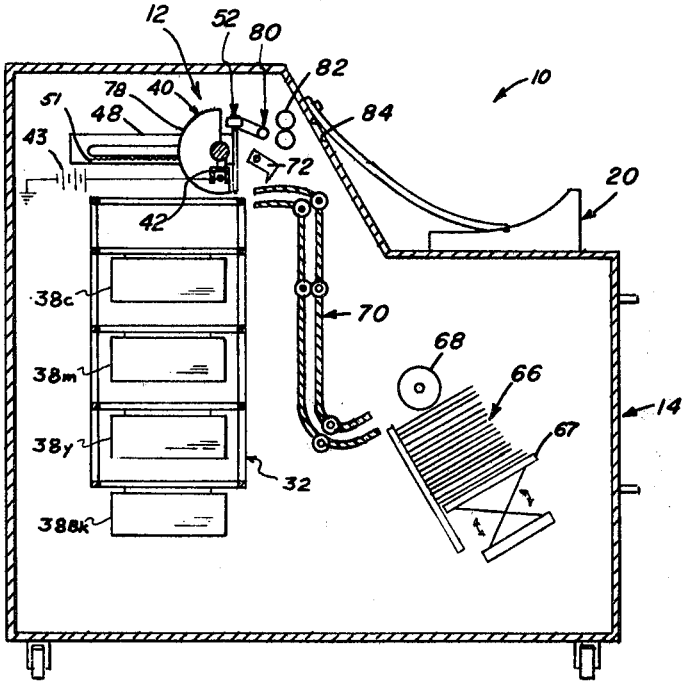
FIG. 4 is a schematic side elevational view, in cross-section, of the structure of FIG. 3 taken along lines 4—4 of FIG. 3.

FIG. 3 shows the layout of a track assembly 32 describing the path associated with the electrophotographic process stations of the copier 10 for the image-carrier sheets. The image-carrier sheets P are transported seriatim about the track (in the direction of arrow A) into operative relation with the various electrophotographic process stations in any well known manner, such as by a tow mechanism or drive rollers. The sheets are first transported past a corona charger 36. The charger 36, coupled to a DC or biased AC electrical potential 37, lays down a uniform electrostatic charge on the sheets. The sheets are then delivered seriatim to the zone $E_x$ where they are respectively stopped at the registration location and exposed to the related reflected light images. Such exposures modify the charge on the sheets in their respective areas I to form electrostatic charge patterns corresponding to the related images respectively. After the sheets are exposed, they are transported to a developing station 38.

The developing station 38 includes a plurality of magnetic brush assemblies **38*c*, 38*m*, 38*y* and 38*Bk*, such as shown for example in U.S. Pat. No. 3,703,395 issued Nov. 21, 1972 in the name of Drexler et al. The assemblies contain pigmented electroscopic marking particles (toner), such as shown in U.S. Pat. No. 3,893,935 issued July 8, 1975 in the names of Jadwin et al. The colors of the particles in the respective assemblies are complementary to the color separation images (i.e. cyan, magenta, yellow) and black. As the image-carrier sheets travel in the track assembly 32**, they are respectively directed to appropriate magnetic brush assemblies. The magnetic brush assemblies bring the marking particles into contact with the charge patterns on the sheets, and the particles electrostatically adhere to the charge patterns to develop such patterns to form transferable toner images on such sheets. That is, the image-carrier sheet bearing the red color separation image is developed with cyan particles forming a transferable cyan toner image; the image-carrier sheet bearing the green color separation image is developed with magenta particles forming a transferable magenta toner image; the image-carrier sheet bearing the blue color separation image is developed with yellow particles forming a transferable yellow toner image; and the image-carrier sheet bearing the black image is developed with black particles forming a transferable black toner image.

Once the charge patterns on the image-carrier sheets are developed (forming the respective transferable toner images), the sheets are transported seriatim about the track assembly 32 to a transfer station 40. At the transfer station, the toner images are respectively transferred to a receiver member. The transfer station 40 includes a corona charger 42 electrically coupled to a DC or biased AC potential source 43 (see FIG. 4). The charger 42 is supported by bearings 44 mounted on a shaft 46 (FIG. 5) for relative rotation with respect to the shaft. The longitudinal dimension of the charger 42 (parallel to shaft 46) is greater than the dimension of the image area I of an image-carrier sheet measured in the direction of sheet travel. The shaft 46 is, in turn, supported in slots 48' of guide members 48. The guide members 48 are parallel and have respective longitudinal axes transverse to the track assembly 32 as it passes through the transfer station 40. A reversible drive motor M is coupled to the shaft 46 to rotate such shaft about its longitudinal axis (see FIG. 3). Gears 50, fixed on the shaft 46, mate respectively with racks 51 supported by the guide members 48. Accordingly, as the shaft 46 is rotated, the interaction of the gear 50 and rack 51 reciprocally moves the shaft in the slots 48' transverse to the longitudinal axis of the shaft.

A pair of vacuum housings 78 are mounted on the shaft 46 for rotation with the shaft. The housings 78, which are connected through a valved conduit C to a vacuum source V are in the form of segmented rollers having vacuum ports 79 through their peripheral surface. The dimension of such peripheral surface is substantially equal to dimension of a receiver member measured in the direction of travel of the shaft 46, and the radius of the rollers is such that when the housings are moved by the shaft the peripheral surface is in juxtaposition with the plane extending between the runs of the track assembly 32.

Figure 8:
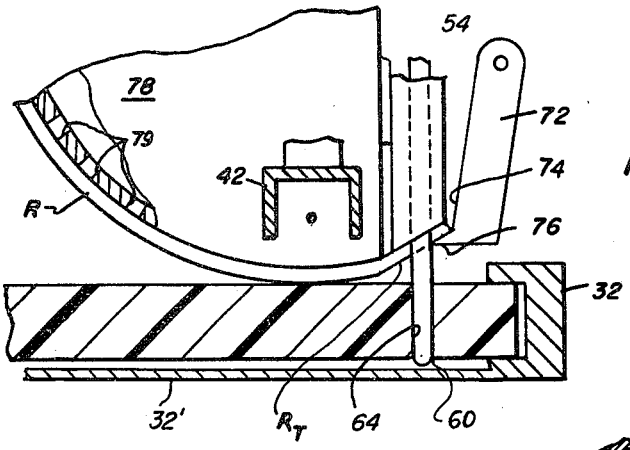
FIG. 8 is a view similar to FIG. 6 showing a clamped receiver member out of image transfer relation with a registered image-carrier sheet.
Figure 9:
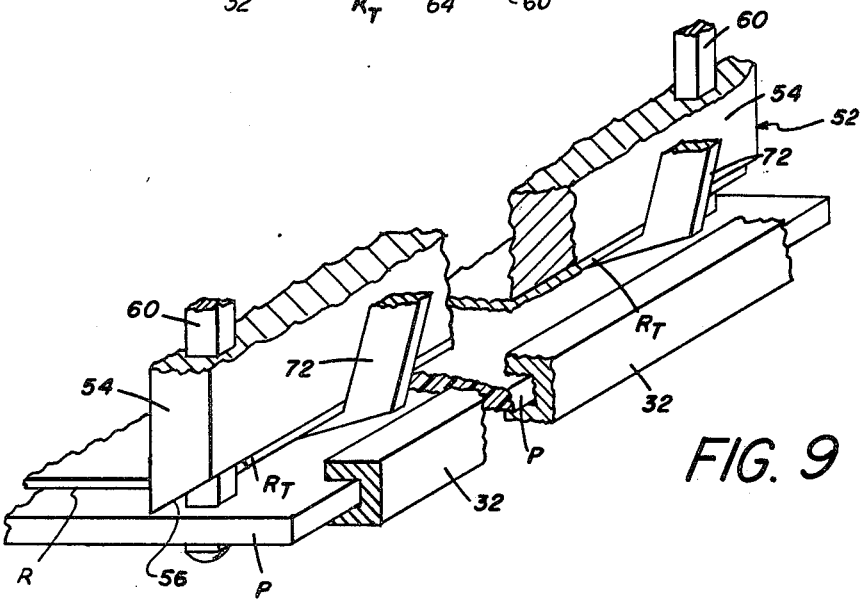
FIG. 9 is a view in perspective of a portion of the registering apparatus of this invention showing a registered image-carrier sheet and a clamped receiver member.
Figure 10:
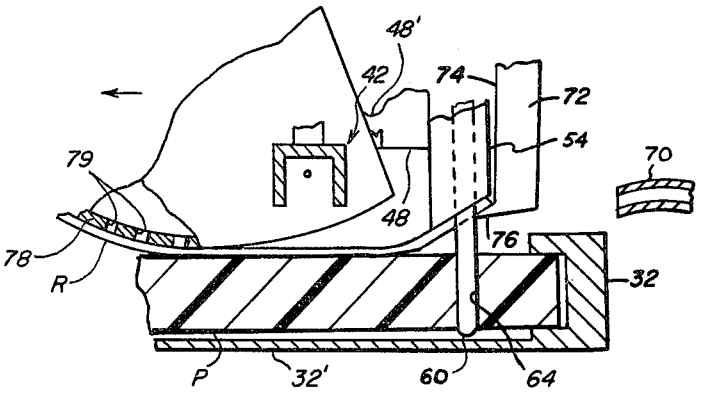
FIG. 10 is a view similar to FIG. 6 showing a clamped receiver member being brought into image transfer relation with a registered image-carrier sheet.

The transfer station 40 further includes an image-carrier positioning apparatus 52. The positioning apparatus 52 comprises an elongated member 54 extending between and attached to one end of the guide members 48, just inside one run of the track assembly 32 (see FIGS. 5 and 9). The member 54 has a chamferred surface 56 and a pair of channels 58. Registration pins 60 are reciprocally movable in the channels 58. The pins 60 are respectively driven by solenoids 62, for example, actuated by signals produced by the logic and control unit 22. The pins are adapted to be received in registration perforations 64 in the image-carrier sheets (see, for example, FIG. 8). That is, as an image-carrier sheet is transported into the transfer station 40, the pins 60 are moved downwardly and seek the perforations 64 to extend into such perforations and stop the sheet at a predetermined location relative to the transfer station. As noted above, the perforations 64 have a specific relation to the image areas I of the respective image-carrier sheets (see FIG. 11), such relation being established by using the perforations to stop such sheets at the registration location in the exposure station $E_x$. Therefore, when successive sheets are stopped by the apparatus 52 at the transfer station 40, successive image areas are positioned at the same registration location relative to the transfer station.

The developed related transferable toner images on the respective image-carrier sheets are transferred seriatim in accurate superposed register onto a receiver member, such as a cut sheet of plain bond paper, for example. A supply 66 of receiver members is supported in a hopper 67 located in the housing 14 of the copier 10 (see FIG. 4). The hopper 67 is, for example, elevator-assisted to maintain the top most receiver member in operative engagement with a motor driven feed mechanism 68, such as a rotating vacuum feeder for example. The feed mechanism 68 is selectively actuated by a signal from the logic and control unit 22 to remove the top most receiver member from the supply and deliver such member to a transport 70. At substantially the same time as the feed mechanism is actuated, the motor M is actuated by a signal from the unit 22 to rotate the shaft 46 counter-clockwise (in FIG. 5) to move the shaft to its phantom line position of FIG. 5.

The transport 70 delivers the receiver member to the transfer station 40 between the pins 60 of the positioning apparatus 52. The signal from logic and control unit 22 to actuate the feed mechanism 68 is timed such that transport 70 delivers the receiver member (e.g. member R) adjacent to the transfer station 40 prior to the image-carrier sheet $P_1$, bearing the first of the related toner images, arriving at the transfer station. The linear velocity imparted to the receiver member by the transport 70 insures that such member travels over a plate 32' extending between runs of the track assembly 32. The transport 70 may include a mechanism (not shown) for squaring up the receiver member relative to the transfer station.

Figure 6:
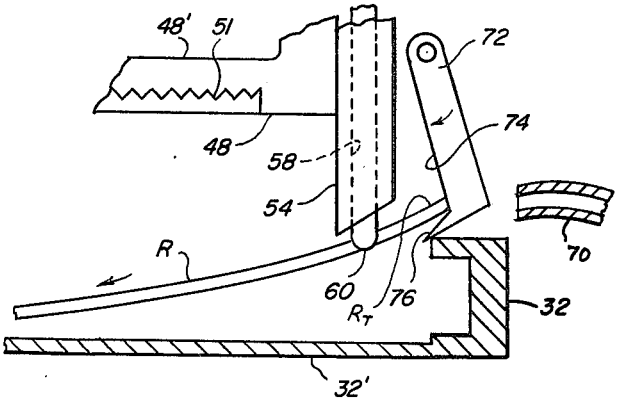
FIG. 6 is an enlarged view of a portion of the registering apparatus of FIG. 5 showing a receiver member, being delivered to the registering apparatus, prior to clamping of such member to the registering apparatus.
Figure 7:
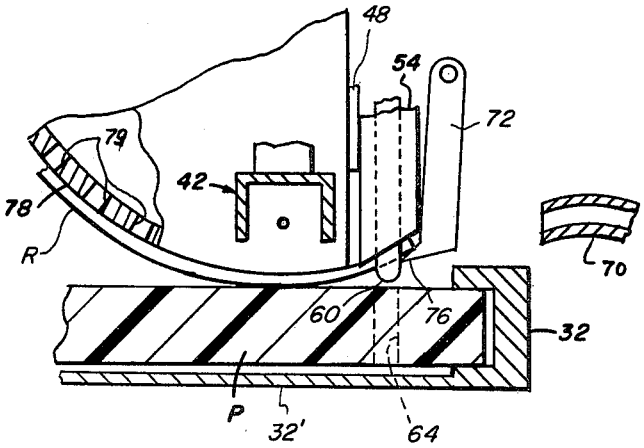
FIG. 7 is a view similar to FIG. 6 showing an image-carrier sheet prior to being registered by the registering apparatus.

As the receiver member R traverses the plate 32', the logic and control unit produces a signal to actuate a pair of pivotable clamps 72. The clamps 72 respectively include leading edge surfaces 74. The surfaces 74 engage the trail marginal edge $R_T$ of the receiver member as the clamps pivot from their home position (for example, as shown in FIG. 6) to their clamping position (for example, as shown in FIG. 7). The surfaces 74 help to urge the receiver member across the plate 32'. The clamps also respectively include a laterally extending portion 76 which, upon movement of the clamp to the position of FIG. 7, underly the trail edge $R_T$ of the moving receiver member and act on such trail edge to clamp such edge to the chamferred surface 56 of the apparatus 52 (see FIGS. 7–10).

Figure 5:
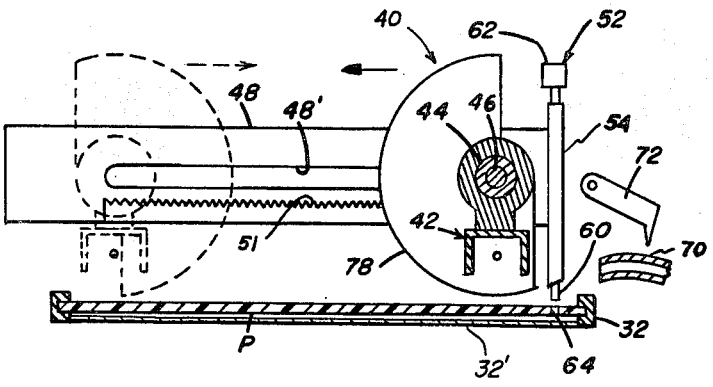
FIG. 5 is a schematic side elevational view, on an enlarged scale, of the registering apparatus according to this invention, taken along lies 5—5 of FIG. 3.

After the receiver member R is clamped to the apparatus 52, the logic and control unit 22 produces signals to operatively couple the vacuum source V to the housings 78 and actuate the drive motor M to rotate the shaft 46 clockwise from broken line position (in FIG. 5). Such rotation of the shaft 46 causes the gears 50 to cooperate with the racks 51 to move the shaft 46 to the right in the slot 48' of members 48 and roll the housings 78 over the clamped receiver member R. As the shaft 46 moves to the right, the vacuum from the source V to the housings 78 is effective through ports 79 to tack the receiver member R to the peripheral surface of the housings (see FIG. 7). Once the shaft 46 returns to its solid line position of FIG. 5 and the receiver member is wrapped on the housings 78, the image-carrier sheet $P_1$ bearing the first of the related toner images is delivered to the transfer station 40 (see FIG. 7). Such sheet is aligned by extension of pins 60 of the apparatus 52 into perforations 64 (see FIG. 8). Since the receiver member is wrapped on the housings, the toner image on the sheet is not contacted as the sheet is positioned and smearing of the image is thereby prevented. The clamped receiver member R is then in accurate registered alignment with the image area of such sheet, and with the image areas of subsequently registered image-carrier sheets.

After sheet $P_1$ is registered, the logic and control unit 22 produces signals to turn on the charger 42, actuate the motor M to rotate the shaft 46 counter-clockwise (in FIG. 5), and interrupt application of vacuum to the housing 78. The rotation of the shaft 46 effects movement of the shaft to the left to unwrap the receiver member, positioning such member in transfer relation with the toner image on the sheet $P_1$, and move the corona 42 across the receiver member and sheet. The corona 42 applies an electrical transfer potential incrementally (element by element) to the receiver member. The source 43 of potential for the corona is chosen such that the transfer potential exhibits an attractive force on the particles of the toner image greater than the electrostatic force holding the particles on the image-carrier sheet. Accordingly, the toner image is transferred line-by-line to the receiver sheet.

After the transfer of the first of the related toner images is completed, the logic and control unit 22 produces signals which open the valve in conduit C to couple the vacuum source V to the housings 78, and actuate the motor M to rotate the shaft 46 clockwise to move the shaft 46 to the right, back toward its initial position (solid line of FIG. 5). As the shaft moves to the right, the housings 78 roll across the receiver member R and the vacuum is effective through ports 79 to tack such member to the housings. The receiver member is thus removed from transfer relation with the image-carrier sheet.

At the completion of the return of the shaft 46 to its initial position, the pins 60 are retracted from the perforations 64 by the solenoids 62. The first image-carrier sheet $P_1$ is then transported out of the transfer station 40 and the next image-carrier sheet $P_2$, bearing the second of the related toner images, is transported into the transfer station. The pins 60 are extended by the solenoids 62 and, in the manner described above, are received in the perforations in such sheet to position such sheet at the predetermined location in the transfer station. Since the receiver member R remains clamped to the apparatus 52, such member is accurately located relative to the image area of the newly positioned image-carrier sheet. During the next transfer operation, carried out by moving the shaft 46 back and forth across the receiver member R and sheet $P_2$, the housings 78 position the receiver member in image transfer relation with the transferable toner image on such sheet and remove such member, in the above described manner. Thus the toner image on sheet $P_2$ is transferred onto the receiver member R in accurate superposed register with the first transferred image on the member.

The transfer of subsequent related transferable toner images, for example from the image-carrier sheets $P_3$, $P_4$, is repeated in the same manner as described above. That is, the image-carrier sheets are respectively transported into the transfer station 40 and positioned by pins 60 at the predetermined location; their transferable toner images are transferred to the receiver member R in accurate superposed register with prior transferred images; and the sheets are transported away from the transfer station until a complete reproduction is formed on the receiver member R. After the reproduction is completed by transfer of the last of the related toner images to the receiver member, the shaft 46 is again returned to its initial starting position (solid line position of FIG. 5) with the receiver member tacked to the housings 78. The logic and control unit 22 then produces signals to pivot the clamps 72 away from their clamping engagement with the trail edge R of the receiver member, and to interrupt the vacuum to the housings 78. The receiver member is then free to be removed from the transfer station 40 such as by a vacuum belt transport arrangement 80, for example, engaging the surface of the receiver member opposite the surface bearing the transferred images.

The transport arrangement 80 is actuated by a signal produced by the logic and control unit 22 to transport the receiver member from the transfer station to a fuser assembly 82 where the superposed transferred images are fixed to such member, by heat and pressure for example. The receiver member bearing the fixed reproduction is then delivered through a slot 84 in the housing 14 to an exit hopper 86 for operator retrieval. Meanwhile, as each successive image-carrier sheet is transported from the transfer station 40, it is moved through a cleaning station C, which includes a rotating vacuum brush 88 and a lamp 90 for example (see FIG. 3). The lamp is flashed to discharge any charge remaining on a sheet, and any residual toner remaining on an image-carrier sheet is removed by the brush so that such sheet is in condition for receiving uniform electrostatic charge from the charger 36 in preparation for use in reproducing another copy of the document D or a copy of another document.

The invention has been described in detail with particular reference to a preferred embodiment thereof, but it will be understood that variations and modifications can be effected within the spirit and scope of the invention.

I claim:

1. In an electrographic copier having means for forming related transferable images at spaced locations on image-carrier means movable along a travel path, means for stopping such image-carrier means to position one transferable image at a predetermined location in said path, and transferring means mounted adjacent to said path and movable relative to such stopped image-carrier means for transferring a transferable image from such image-carrier means to a receiver member, the improvement comprising:

means for clamping a receiver member to said stopping means; and means, operatively associated with said transferring means, for (i) positioning such clamped receiver member, during movement of said transferring means, in transfer relation with such one transferable image on the stopped image-carrier means, and following transfer of such one transferable image, (ii) removing such receiver member from such transfer relation while keeping such receiver member clamped to said stopping means so that such image-carrier means can be stopped to position another related transferable image at said predetermined location, whereat such receiver member has the same position relative to such other related transferable image as it had to such one transferable image, whereby such related images when transferred are in accurate superposed register on such receiver member.

2. The invention of claim 1 wherein said receiver member positioning means includes means for supporting said transfer means for reciprocal movement across the image-carrier means in a direction transverse to said image-carrier means travel path, said transfer means transferring a transferable image when moved in one direction across said image-carrier means.

3. The invention of claim 2 wherein said receiver member positioning means is operative to effect removing of a receiver member when said transfer means is moved in the opposite direction across said image-carrier means.

4. The invention of claim 3 wherein said receiver member positioning means further includes at least one segmented roller having a ported peripheral surface, and means for selectively applying a partial vacuum to said roller effective through such ported surface for tacking the receiver member on such surface.

5. The invention of claim 2 wherein said clamping means includes means for retaining a marginal edge of a receiver sheet substantially parallel to the direction of said image-carrier means travel path.

6. In an electrographic color copier having means for forming related transferable color separation images respectively on discrete photoconductive film sheets movable seriatim in a travel path, means stopping one film sheet to position the transferable image thereon at a predetermined location in said path, and corona means mounted adjacent to said path and movable relative to such stopped film sheet for transferring the transferable image from such film sheet to a receiver member, the improvement comprising:

means for clamping a receiver member to said stopping means; and means operatively associated with said corona means for (i) positioning such clamped receiver member, during movement of said transferring means, in transfer relation with such one transferable image on the stopped film sheet, and following transfer of such one transferable image, (ii) removing such receiver member from such transfer relation while keeping such receiver member clamped to said stopping means so that another film sheet can be stopped to position another related transferable image at said predetermined location, whereat such receiver member has the same position relative to such other related transferable image as it had to such one transferable image, whereby such related images when transferred are in accurate superposed register on such receiver member to provide a quality color reproduction.

7. The invention of claim 6 wherein said stopping means includes at least one pin selectively movable into the travel path to engage a film sheet at a predetermined location relative to the transferable image formed on such sheet, and an elongated member associated with said at least one pin, said elongated member having a surface extending in the direction of movement of said film sheets in such path and adapted to cooperate with said retaining means for holding a marginal edge of a receiver member in clamped engagement therebetween.

8. The invention of claim 6 wherein said receiver member positioning means includes means for supporting said corona means for reciprocal movement across a film sheet in a direction transverse to said film sheet path, said corona means transferring a transferable image when moved in one direction across said film sheet.

9. The invention of claim 8 wherein said receiver member positioning means further includes at least one segmented vacuum roller having a ported peripheral surface, and means for selectively applying a partial vacuum to said roller when said corona means is moved in the opposite direction across a film sheet, whereby vacuum is effective through such ported peripheral surface to tack a receiver member to such surface.

10. Method for transferring in accurate superposed register related transferable images from image-carrier means onto a receiver member, said method comprising the steps of:

clamping a receiver member at a given location;

positioning the image-carrier means at a predetermined location with one of the related transferable images adjacent to the clamped receiver member;

positioning the clamped receiver member in image transfer relation with the one transferable image;

transferring the one transferable image to the receiver member;

removing the receiver member from such transfer relation position while maintaining the member clamped at such given location;

repositioning the image-carrier means at such pedetermined location with another of the related transferable images adjacent to the clamped receiver member, whereat such receiver member has the same position relative to such other related transferable image as it had to such one transferable image; and transfering such other transferable image to such member, whereby such transferred images are in accurate superposed register on the receiver member.

11. The invention of claim 10 wherein in the clamping step, the receiver member is clamped along a marginal edge; and wherein in the receiver member positioning and removing steps, the marginal edge opposite the clamped marginal edge is moved in a direction perpendicular to such edge.

12. Method for making a color copy of multicolor input information comprising the steps of:

forming charge patterns on discrete sheets corresponding respectively to color separation images of such input information;

developing such charge patterns respectively with electroscopic marking particles of colors corresponding to such color separation images to form related transferable images;

clamping a receiver member at a given location;

positioning one discrete sheet at a predetermined location with its transferable image adjacent to the clamped receiver member;

positioning the clamped receiver member in image transfer relation with such transferable image;

transferring such transferable image to the receiver member;

removing the receiver member from such transfer relation while maintaining such member clamped at such given location;

sequentially positioning other discrete sheets at such predetermined location with the other related transferable images respectively adjacent to the clamped receiver member, whereat such receiver member has the same position relative to such other related transferable images as it had to such one transferable image;

transferring such other transferable images to such member, whereby such transferred images are in accurate superposed register on the receiver member; and fusing the transferred superposed images to the receiver member to form a quality color reproduction of the multicolor input information.

* * * * *